US008746018B2

(12) United States Patent
Christ

(10) Patent No.: US 8,746,018 B2
(45) Date of Patent: Jun. 10, 2014

(54) APPARATUS AND METHOD FOR THE TREATMENT OF STRAND-SHAPED TEXTILE PRODUCTS

(75) Inventor: Wilhelm Christ, Michelbach an der Bitz (DE)

(73) Assignee: Then Maschinen GmbH, Schwabisch Hall (DE)

( * ) Notice: Subject to any disclaimer, the term of this patent is extended or adjusted under 35 U.S.C. 154(b) by 1165 days.

(21) Appl. No.: 12/698,480

(22) Filed: Feb. 2, 2010

(65) Prior Publication Data

US 2010/0175200 A1 Jul. 15, 2010

Related U.S. Application Data

(63) Continuation of application No. PCT/EP2008/059940, filed on Jul. 29, 2008.

(30) Foreign Application Priority Data

Aug. 2, 2007 (DE) ..... 10 2007 036 408

(51) Int. Cl.
*D06B 3/28* (2006.01)

(52) U.S. Cl.
USPC ..... 68/178; 68/179

(58) Field of Classification Search
USPC ..... 68/177–178, 179; 8/152, 151, 151.2
See application file for complete search history.

(56) References Cited

U.S. PATENT DOCUMENTS 4,314,464 A 2/1982 Gran
4,483,032 A * 11/1984 Christ et al. ..... 8/149.1
4,489,575 A * 12/1984 Arashi ..... 68/177
4,825,491 A * 5/1989 Miyamoto et al. ..... 8/152
4,829,620 A * 5/1989 Christ et al. ..... 8/149.1
4,862,545 A * 9/1989 von der Eltz et al. ..... 8/149.1
4,862,546 A * 9/1989 von der Eltz et al. ..... 8/149.1
5,235,828 A * 8/1993 Aurich et al. ..... 68/62

(Continued)

FOREIGN PATENT DOCUMENTS

CN 1580349 A 2/2005
CN 2742007 Y 11/2005

(Continued)

OTHER PUBLICATIONS

Chinese Office Action dated Nov. 24, 2011 (and English translation thereof) in counterpart Chinese Application No. 200880109921.4.

(Continued)

*Primary Examiner* — Joseph L Perrin

(74) *Attorney, Agent, or Firm* — Holtz Holtz Goodman & Chick PC

(57) ABSTRACT

An apparatus for the treatment of strand-shaped textile products in the form of a continuous material strand which is circulated at least during part of the treatment, includes an elongated, essentially tubular treatment container and a transport nozzle array that can be charged with a gaseous transport medium stream. In the treatment container is arranged, adjoining a material strand inlet, a storage section for receiving a piled-up material strand package is provided with a sliding floor that is inclined, at least in sections, in a manner descending from a pile-up unit toward a head part of the treatment container. Charge elements are provided at least in the region of the transport nozzle array to charge the material strand with a liquid treatment agent.

34 Claims, 8 Drawing Sheets

(56) References Cited

U.S. PATENT DOCUMENTS

| | | | | |
|---|---|---|---|---|
| 5,381,678 | A * | 1/1995 | Chiang | 68/177 |
| 5,850,651 | A | 12/1998 | Ishimaru et al. | |
| 6,672,114 | B2 * | 1/2004 | Glover et al. | 68/178 |
| 2002/0174694 | A1 * | 11/2002 | Bozzo | 68/177 |
| 2006/0051509 | A1 * | 3/2006 | Cordes et al. | 427/345 |
| 2006/0150343 | A1 * | 7/2006 | Christ | 8/149.1 |
| 2006/0180182 | A1 * | 8/2006 | Cordes et al. | 134/41 |
| 2006/0253999 | A1 | 11/2006 | Christ et al. | |
| 2007/0074354 | A1 * | 4/2007 | Hirsch | 8/149 |
| 2007/0137562 | A1 * | 6/2007 | Cordes et al. | 118/325 |
| 2007/0283725 | A1 * | 12/2007 | Cordes et al. | 68/5 C |

FOREIGN PATENT DOCUMENTS

| | | | | |
|---|---|---|---|---|
| CN | 1865575 | A | 11/2006 | |
| DE | 2 207 679 | | 8/1973 | |
| DE | 19813477 | A1 | 10/1999 | |
| EP | 0 215 745 | | 3/1987 | |
| EP | 1 722 023 | A2 | 11/2006 | |
| FR | 2778417 | A | 11/1999 | |
| GB | 1 587 069 | | 3/1981 | |
| GB | 2 078 803 | A | 1/1982 | |
| GB | 2 404 925 | A | 2/2005 | |
| GB | 2404925 | A * | 2/2005 | D06B 3/28 |
| JP | 7305261 | A | 11/1995 | |

OTHER PUBLICATIONS

International Search Report mailed Nov. 17, 2008 issued by International Searching Authority in PCT/EP2008/059940 (6 pages).

* cited by examiner

APPARATUS AND METHOD FOR THE TREATMENT OF STRAND-SHAPED TEXTILE PRODUCTS

This is a continuation of International Application PCT/EP2008/059940 filed Jul. 29, 2008, which claims priority of German Patent Application No. DE 10 2007 036 408.5 filed Aug. 2, 2007, the entire disclosure of each of which is incorporated herein by reference.

FIELD OF THE INVENTION

The invention relates to an apparatus for the treatment of strand-shaped textile products in the form of a continuous material strand which is circulated at least during part of the treatment. Furthermore, the invention relates to a method for the treatment of such a textile product with the use of a new apparatus.

BACKGROUND OF THE INVENTION

In the treatment of strand-shaped textile products it has been known to introduce the textile products in a closed treatment container, to connect their ends to each other to form a continuous material strand, and to start circulating said strand in a pre-specified direction of rotation, and to subject the circulating material strand to a treatment. Such treatment potentially includes subjecting the material strand to the action of an, in particular fluid, treatment agent (bath) and/or drying, tumbling, or otherwise treating the material strand in order to change the properties of the textile product, e.g., the hand, the plushness and the like. The circulating material strand may be driven by mechanical means, e.g., a winch; however, nowadays, as a rule, hydraulic or pneumatic drive systems are used, these systems operating in accordance with the Jet principle by using a Venturi transport nozzle, through which the material strand is being passed and which is charged with a liquid and/or gaseous transport medium, e.g., a bath, air, a steam/air mixture, inert gas and the like. An overview can be found, e.g., in: Dr. H. U. von der Elz, Ing. W. Christ, "Aerodynamic System for Dyeing Piece Goods," International Textile Bulletin, Dyeing/Printing/Finishing 31 (1985), 3; pages 27-41).

Inasmuch as the strand length is considerably greater than the dimensions of the treatment container, the circulating material strand must be temporarily piled up on its circulation path. The piled up material strand package is received by a storage, in which the circulating material strand is continuously entered and from where the material strand is continuously removed on the opposite side.

For example, in high-temperature (HT) piece-dyeing machines comprising a treatment container configured as a pressure-proof, essentially cylindrical vat, the material storage is completely U-shaped with upward extending legs, whereby the material strand that is being continuously removed on the output side by a winch is passed through a Venturi transport nozzle and, along a transport section downstream of the transport nozzle, continuously entered into the storage. A pile-up device that piles up the material strand is interposed between the transport section and the material strand input into the storage. In such jet piece-dying machines utilizing the aerodynamic principle, liquid treatment agent is admixed either to the transport gas stream or is applied to the moving material strand in the region of the Venturi nozzle array. An example of such an apparatus utilizing the aerodynamic principle is described in EP 0 945 538.

An advantage of the explained jet treatment machines utilizing the aerodynamic principle is that they can be operated at a very low bath ratio (weight of the total bath (=treatment agent) in the container divided by the weight of the material strand to be treated). On the other hand, the textile product in the material package in the storage is exposed to a certain compressive force that is not expedient for certain textile products. Furthermore, the transport section and the material strand themselves introduce liquid treatment agent into the storage, said agent forming uncontrollable puddles and accumulations in the piled-up material package, said accumulations potentially impairing the treatment result and—in any event—requiring an increase of the number of circulations of the strand, in order to achieve a uniform treatment result, e.g., completely uniform dyeing.

In addition to the explained so-called short-term storage machines comprising a cylindrical treatment container and essentially U-shaped material storages, so-called long-term storage machines with bath circulation are used for certain textile products, i.e., machine systems utilizing the hydraulic principle, said machines being operated at a high bath ratio. An essential feature of these long-term storage machines is that their treatment container comprises an elongated, frequently essentially tubular, container part having a storage section for the accommodation of the piled up material strand and whose material strand output side is connected to a Venturi transport nozzle adjoined by a transport section leading to the material strand input side of the treatment container. In machines utilizing the hydraulic principle, the elongated, horizontally arranged storage section is more or less completely flooded with the bath, so that the piled up strand-shaped piece goods are almost in a floating state, with the result that no excessive influence of force on the material package occurs as it is passed through the material storage. An example of such a long-term storage machine utilizing the hydraulic principle is described in documents French Patent 2 778 417 and in DE Offenlegungsschrift 2 207 679, whereby, however, no separate material strand pile-up device is provided at the material storage input. The storage section of the treatment container in accordance with French Patent 2 778 417 comprises an essential straight sliding floor that is arranged at a distance above the container wall in a manner so as to descend from the material strand input side to the material strand output side. In these long-term storage machines comprising a predominantly horizontal treatment container with a small container diameter and with a transport section located below the treatment container, it is possible, as a rule, to achieve material strand velocities of 500 m/min that are employed in practical applications for a creaseless output of the strand-shaped piece goods.

From documents JP-753943 and JP-730505 long-term storage machines have been known, said machines utilizing—in order to drive the circulating material strand—an air/bath mixture or—for drying the material strand—only air, optionally air sucked in from the outside, said air acting on a nozzle element upstream of the transport section. The treatment container of these machines consists of a part that extends, at an angle greater than 45°, from the input side of the material strand steeply downward, said part being adjoined by an intermediate section that, at an angle smaller than 5°, also is inclined downward and that is connected at the material strand output end to a vertically upward extending part that leads to a head part holding the deflecting winch and from where the mentioned transport nozzle begins to extend. The transport nozzle is adjoined by a slightly downward inclined transport section leading to the steeply descending part of the transport container. The circulating material strand is automatically folded in pleats in the steeply descending part of the treatment container, whereby a denser, more compact material package results in the adjoining storage section that is inclined only gently by less than 5° with respect to the horizontal. These machines can operate at a very low bath ratio of up to 1:3 and less. However, the treatment agent accumulating in the transport section is introduced, together with the treatment agent carried along on the material strand, into the material storage, in which said agent drains from the compressed material package into a sump. This introduction of treatment agent into the storage in a hydraulic long-term storage machine is also described in EP 0 512 189 B1, in which a pile-up device adjoins the transport section perfused by treatment agent, said pile-up device performing an oscillating rotating movement about a stationary axis.

SUMMARY OF THE INVENTION

Starting with this prior art, the object of the invention is to provide an apparatus for the treatment of strand-shaped textile products in the form of a continuous material strand, said apparatus combining the advantages of a jet treatment machine with short-term storage utilizing the aerodynamic principle with the advantages of a long-term storage machine and, when using a low bath ratio, also permits the treatment of textile products that, until now, could predominantly only be treated in particular in hydraulic long-term storage machines.

In order to achieve this object, an apparatus and a treatment method that can be carried out with such an apparatus are provided.

The new apparatus is basically of the type of a so-called long-term storage machine with an elongated, essentially tubular treatment container that has a head part with a material strand inlet and a material strand outlet. The continuous material strand that is to be treated and performs at least one circulating movement during part of the treatment is driven by means of a transport nozzle array that can be charged with a gaseous transport medium, so that the apparatus utilizes the aerodynamic principle. Adjoining the transport nozzle array is a transport section that terminates in a storage section of the elongated horizontal treatment container. Material strand-deflecting means are arranged in the head part of the treatment container, said means, e.g., being in the form of a driven or free-running winch that inputs the continuously removed material strand in the transport nozzle array. In addition, the head part of the treatment container is associated with blower means that communicate with the transport nozzle array and generate a gaseous treatment medium stream.

Downstream of the material strand inlet, a storage section receiving the piled up material strand package is provided in the elongated, essential tubular treatment container that has a cross-sectional form that is circular. A sliding floor for the material strand package is provided in the storage section at a distance above the container wall below, whereby pile-up means for the materials strand are located between the sliding floor and the transport section.

The sliding floor, the upper side of which comes into contact with the material strand package and which is preferably configured so as to be friction-reducing, is inclined—at least in sections—so as to descend from the pile-up means toward the head part in an oblique manner, in order to thus achieve a gravitational effect that promotes the transport of the piled up material strand.

In addition, the apparatus comprises means for applying to the material strand a liquid treatment agent (bath), at least in the region of the transport nozzle array. If necessary, the transport section adjoining the transport nozzle array is allocated devices for draining excess treatment agent that has been carried along by the material strand. As a result of this, it is avoided that treatment agent introduced from the transport nozzle array into the transport section, said agent draining from the material strand when passing through the transport section, is introduced into the material storage by way of the pile-up means. To be exact, it has been found that such a more or less uncontrolled entry of the treatment agent into the material storage can lead to uneven wetting of the material strand entering the storage, thus having the consequence of an undesirable influence on the opening of the material strand at the exit from the pile-up means, and lead to the formation of puddles or the accumulation of fluid in the material strand package that can potentially require an increased number of strand circulations in order to achieve a uniform treatment result.

In a preferred embodiment, the sliding floor is configured—at least in sections—essentially descending in a straight line, so that said floor acts in the way of an inclined plane. The incline of the sliding floor relative to the horizontal is, as a rule, within a range of from approximately 10° to approximately 30°; preferably, the angle of inclination is in the range of 15°. The tangent of this angle of inclination, to be exact, corresponds approximately to the coefficient of friction between the textile product and the friction-reducing sliding surface of the sliding floor. The piled up material slides on this inclined plane as a migrating stack at almost the same speed, whereby—by interacting with the pile-up means—it is achieved that the piled up material strand package is distributed over the entire sliding floor length, so that excessive compacting of the piled up goods is prevented. In so doing, optimal prerequisites exist for a high-quality material appearance.

In one embodiment, the sliding floor may comprise tubular elements that are arranged parallel next to each other, said elements having a surface displaying minimal friction relative to the material strand. In another embodiment, the sliding floor may comprise flat construction elements having a surface displaying minimal friction relative to the material strand. As a rule, said floor has an essentially gutter-shaped cross-sectional form, whereby at least the elements arranged so as to laterally extend upward from a floor section are provided at a minimal distance from the respectively adjacent container wall. The elements that are provided on both sides of the sliding floor near the respectively adjacent inside surface of the treatment container prevent the textile product from coming into contact with the container wall, said elements being, in particular, configured as flat construction elements or as sliding plates having a friction-reducing surface. Consequently, temperature differences between the textile product and the lateral boundaries of the sliding floor cannot occur, thus providing optimal prerequisites for carrying out various finishing processes.

The transport section is suitably provided on its inside with a surface displaying low friction relative to the passing material strand. In a preferred embodiment, it comprises a jacketed pipe with an internal sliding pipe with a surface displaying low friction relative to the material strand. The internal sliding pipe is provided with orifices for liquid treatment material that is then collected in the outer pipe—as a rule, consisting of steel—of the transport section and that can be drained via drains provided on said outer pipe. It is practical if the internal sliding pipe is composed, at least in part, of coaxial pipe sections, in which case then the connection sites of abutting sliding pipe sections can be configured as treatment agent passages. The sliding pipe sections may comprise—in material strand transport direction—a respectively larger or enlarging diameter, as is, naturally, also conceivable in the case of embodiments having, e.g., an internally coated thin-walled transport section pipe, in which case said pipe can be configured with a cross-section that flares in material strand transport direction. The funnel-like or telescope-like expansion of the transport section in material strand transport direction aids in avoiding an excessive longitudinal pull of the material strand passing through the transport section.

The pile-up means that is located upstream of the material storage and receives the material strand leaving the transport section is suitably designed in such a manner that the material strand, upon entry into the material storage, can be imparted with two movement components, i.e., one movement component approximately parallel to the floor surface of the sliding floor and a second movement component in a transverse direction essentially parallel at a right angle thereto. In so doing, it is possible to influence not only the width but also the height of the material strand package forming on the sliding floor depending on the textile product that is to be treated at a given time, in order to thus achieve optimal conditions for the treatment of the textile product. By being able to adjust a high material strand transport velocity, the circulating time permissible for the respective material strand length is not exceeded.

Viewed in material strand moving direction, pivotally supported planar baffle elements may be arranged between the material strand exit from the pile-up means and the storage section of the treatment container, said baffle elements being controllable as a function of the movement of the pile-up means, said movement causing the pile-up of the passing material strand. These baffle elements may be configured as metal baffles or plates that are pivotally arranged above and below the material strand exit from the pile-up means and are configured to act as material strand guide means.

As a result of this measure, the new apparatus is also suitable for the treatment of textile products of fibrous materials that requires a compression effect on the material strand in order to achieve the desired degree of fibrillation. Such fibrous materials are, e.g., cellulose fibers that are commercially available under the Lyocell® and Tencel® tradenames. The baffle elements permit a metered adjustment of the compression effect.

Due to its novel way of guiding the material strand, of depositing the material strand and of opening the material strand in the material storage, the new apparatus utilizing the aerodynamic principle permits the treatment of strand-shaped textile products in an unrestricted manner while producing optimal results, such treatment having been possible until now only with long-term storage machines utilizing the hydraulic principle. In contrast, the new apparatus retains the advantages of a particularly low bath ratio in the range of 1:1.5 to 1:3. In addition, the decompaction of the treated strand-shaped piece goods, i.e., the so-called bulk development, is improved by reducing the moisture load at high material strand velocities. Material strand velocities having a standard value at 1000 m/min can be achieved.

Furthermore, with the use of this apparatus, it is possible to carry out an inventive method for the dry treatment a material strand, whereby the circulating material strand is tumbled by the aforementioned metal baffles or plates.

Developments of the apparatus in accordance with the invention and the treatment method in accordance with the invention are the subject matter of dependent claims.

DETAILED DESCRIPTION

Figure 1:
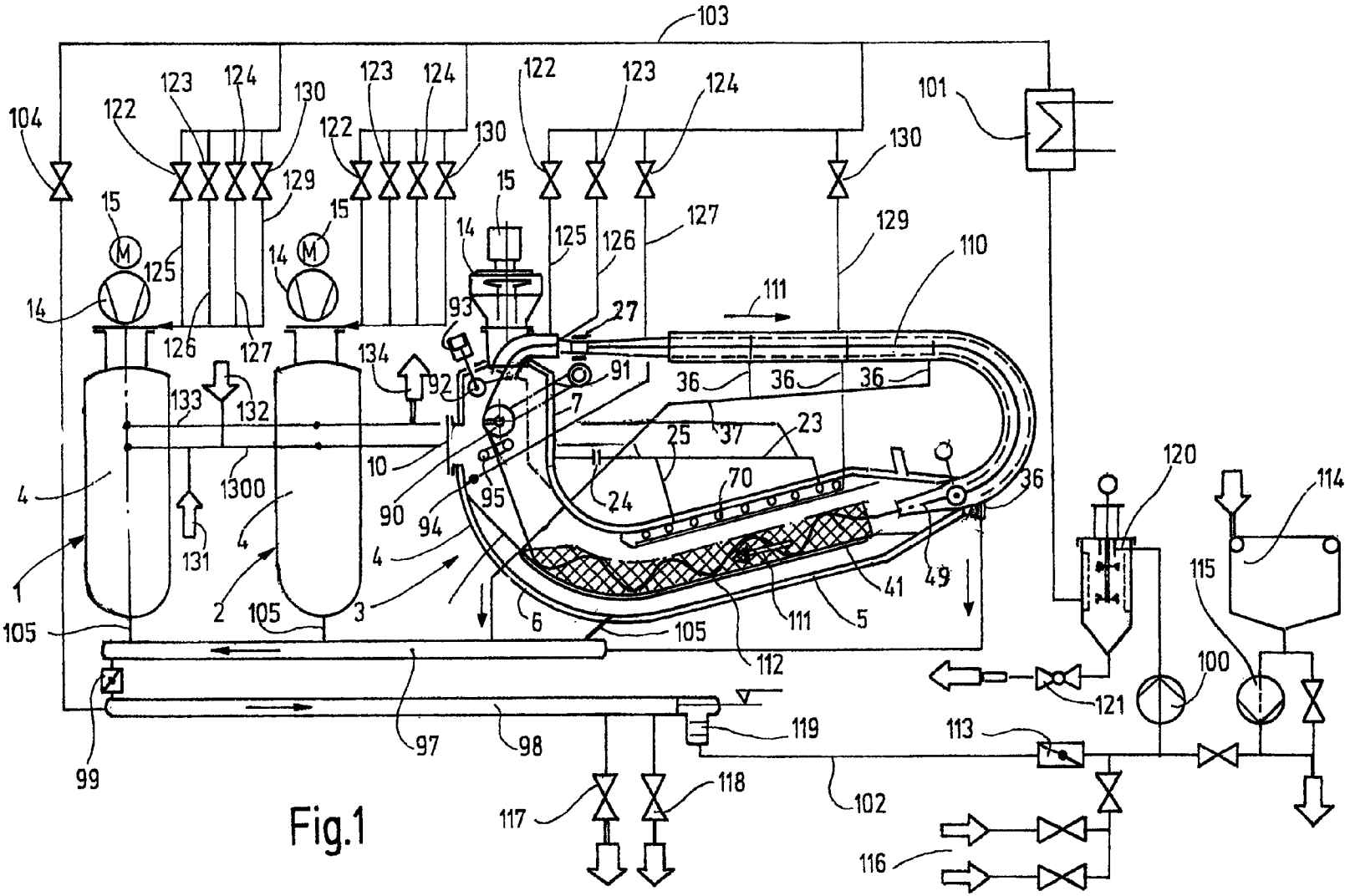
FIG. 1 a schematic illustration of a side view of three interconnected apparatus in accordance with the invention on a treatment plant, each being represented in the embodiment of the high-temperature piece-goods dyeing machine and illustrating an apparatus in axial longitudinal section, said apparatus being depicted rotated by 90° relative to the two other apparatus.

The treatment plant for strand-shaped textile products shown by FIG. 1 is composed of three interconnected, equally designed apparatus 1, 2, 3, each of said apparatus being configured as a high-temperature piece-dyeing machine and being set up for the treatment of a single material strand. Whereas the two apparatus 1, 2 are schematically shown in side elevation with the narrow side of their treatment container 4 facing the viewer, the apparatus 3 is shown rotated by 90° in axial longitudinal section in order to better illustrate details. In particular, this apparatus 3 will be further explained in detail with reference to FIGS. 2 through 9. This apparatus may also be used as a single-strand treatment machine or device.

Figure 2:
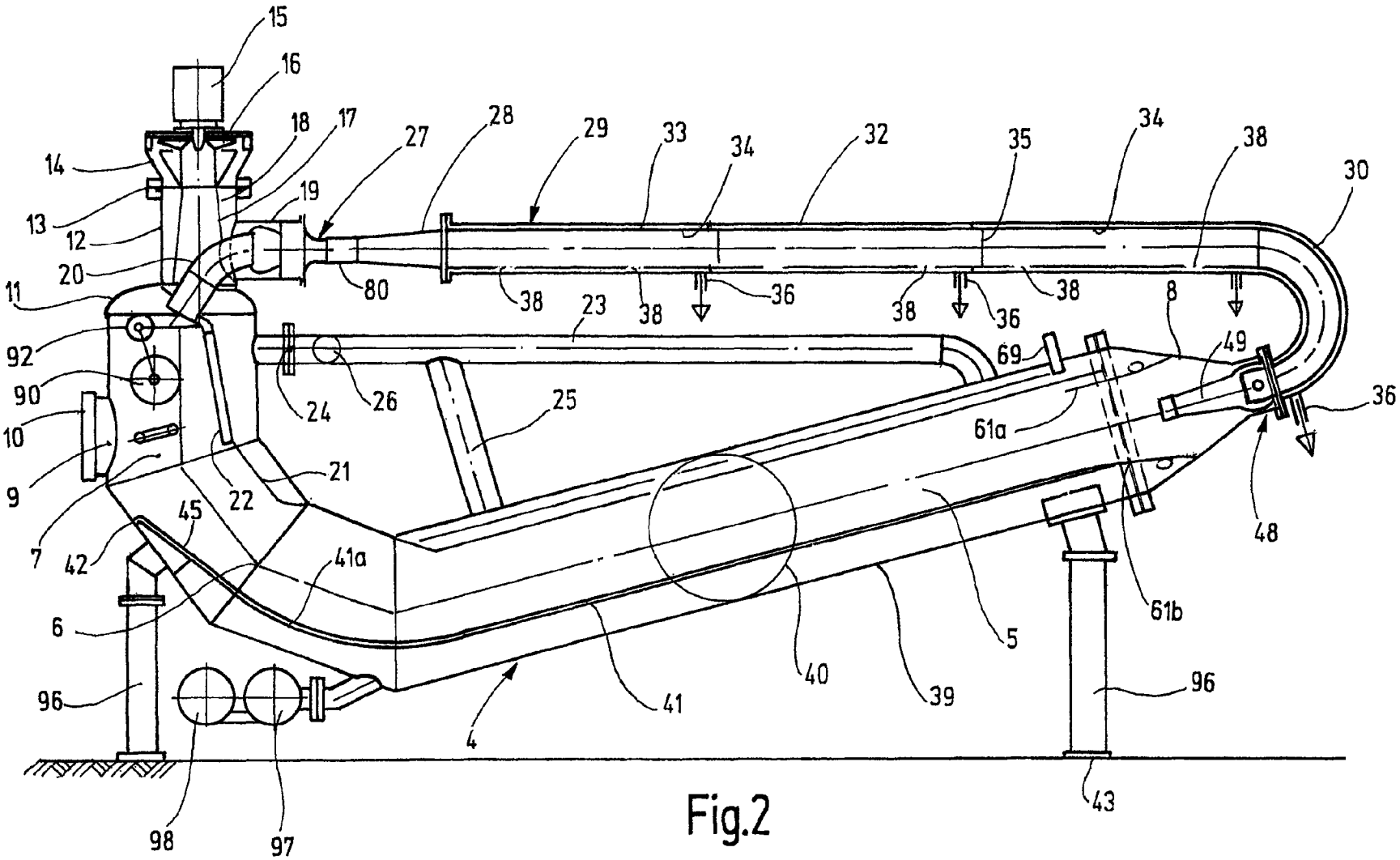
FIG. 2 a side elevation, in longitudinal section, of an apparatus in accordance with FIG. 1.
Figure 3:
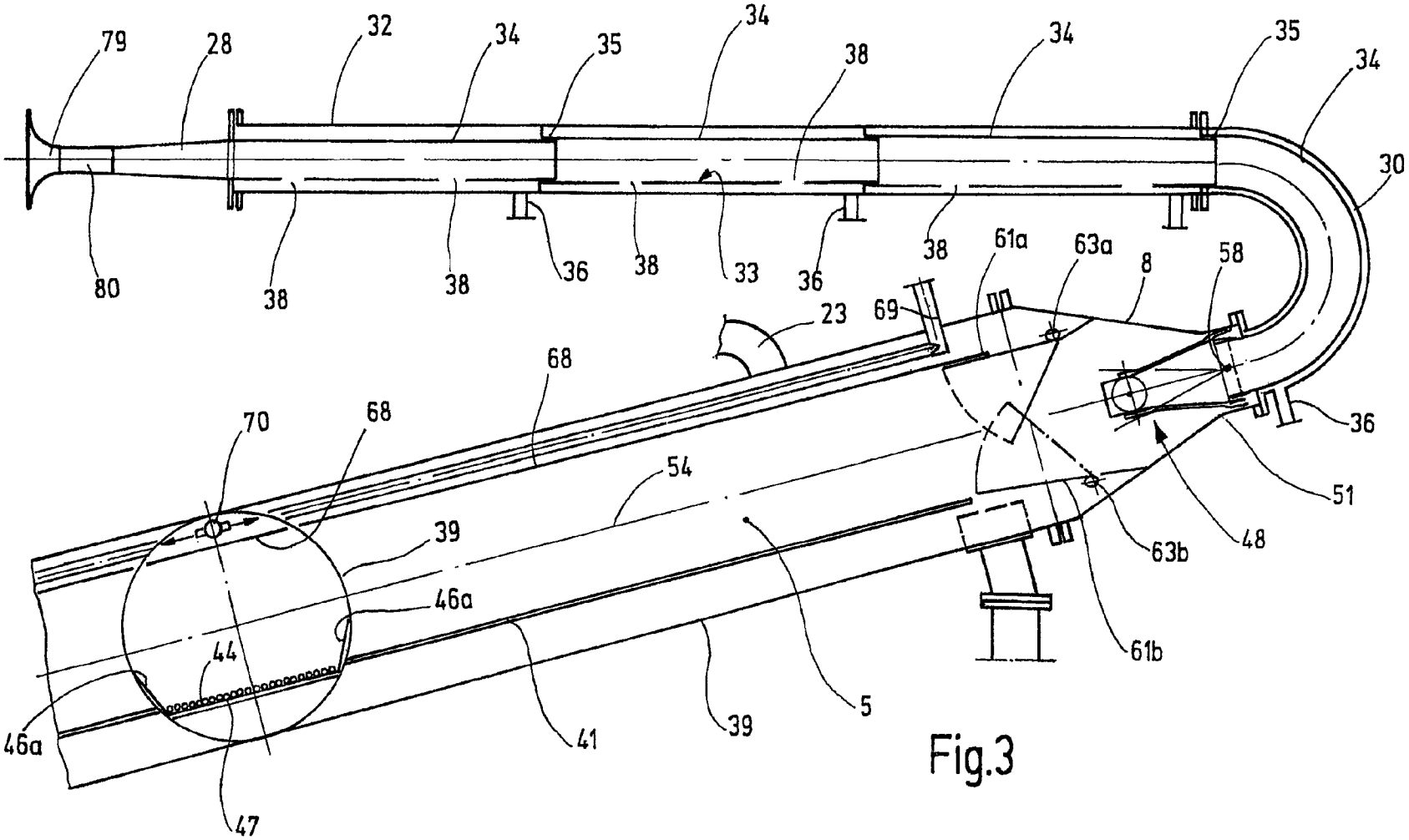
FIG. 3 a longitudinal section, on a different scale and depicting a detail, of the transport section and the storage section of the treatment container of the apparatus in accordance with FIG. 1.

As has already been mentioned, each of the apparatus 1, 2, 3 comprises a treatment container 4 that is designed in a manner common in so-called long-term storage machines. In the present embodiment, the elongated, horizontally arranged treatment container 4 has a lower container part 39 having the shape of a circular cylinder as indicated in FIGS. 2, 3, said part forming a storage section 5 and terminating, via an arcuate intermediate part 6, in a head part 7 also having the shape of a circular cylinder, said head part being arranged with an essentially vertically aligned axis. As is obvious from FIG. 2, the intermediate part 6 is preferably configured as a pipe bend segment. A coaxial conical container part 8 forming the material strand inlet is connected to the storage section 5 of the treatment container 4, whereas the material strand exit from the storage section 5 is located in the head part 7. A loading and unloading opening 9 for a material strand to be treated leads into the head part 7, which opening can be closed by means of a pressure-proof closure 10 (FIG. 2).

A torospherical bottom 11 is placed in a pressure-proof manner on the cylindrical head part 7, said bottom being welded to a cylindrical connecting pipe 12 and its longitudinal axis being in vertical alignment. As its upper boundary, the connecting pipe 12 has an annular flange 13 that is screwed to a coaxial blower unit 14. The blower unit 14 may be removed as a unit from the annular flange 13 and, if needed, be replaced with a blower unit displaying different performance or conveying characteristics. The blower unit 14 contains a blower wheel 16 driven by a speed-controllable electric motor 15, said blower wheel being coaxial to the connecting pipe 12 and communicating—via an intake pipe 17 arranged in the connecting pipe 12 and being coaxial therewith—with the interior space of the treatment container 4, and being able to take in air or a steam/air mixture from said space. On the pressure side, the blower wheel 16 acts as a conveyor into a pressure channel 18 that is enclosed by and coaxial to the intake pipe 17, said pressure channel being radially delimited by the connecting pipe 12 and by the intake pipe 17 and terminating into a nozzle housing 19 extending at a right angle from the connecting pipe 12.

Located inside the connecting pipe 12 is a material strand inlet part 20 having the form of a pipe bend, said inlet part laterally passing through the intake pipe 17 and terminating in the cylindrical head part 7 at an angle of inclination of 60° relative to the horizontal. In the vertically aligned cylindrical head part 7, the material strand inlet part 20 is separated from the intake pipe 17 of the blower unit 16 by a flat dividing wall 21 that is equipped with a removable and exchangeable filter panel 22 through which passes the medium (air, steam/air mixture) taken in from the treatment chamber before entering in the intake pipe for retaining fuzz and other impurities.

An equalization line 23 from the head part 7 to the upper side of the storage section 5 of the treatment container 4 is connected to the head part 7, namely, via a diaphragm that can be installed at 24 in the connecting pipe to the head part 7. The equalization line 23 has, extending from it, at least one branch line 25 that leads, at a site in the storage section 23 that is axially remote from the mouth of the equalization line 23, into the container part in the region above its upper central generatrix. The two connections of the equalization line 23 leading to the storage section 5 are disposed to effect a gas equalization. The diaphragm 24 ensures that the predominant intake volume of the blower unit 14 flows through the filter panel 22 and that the intake flow from the upper part of the storage section 5 is taken in axial direction in the best-possible uniform distribution, so that, in the storage section 5, a flow component in the same direction as the material strand transport direction 111 is generated, said flow component being disposed to transport the material strand package sliding in the storage section 5 in order to aid transport, as will still be explained in detail hereinafter. Reference number 26 indicates a connecting flange for the pressure equalization line 23 of the parallel treatment chamber 4 having the same size as in the case of the other two apparatus 1, 2.

The cylindrical transport nozzle housing 19 contains a transport nozzle array that is generally given reference number 27, whereby the setup of said array may be selected consistent with the intended purpose. A particularly preferred embodiment will be explained hereinafter with reference to FIG. 8.

The transport nozzle array 27 is connected, on the strand-input side, to the strand inlet part 20 and is connected, on the strand-output side, to a diffuser that is connected to a transport section 29, whereby one end of said transport section is connected—via a pipe bend 30—to the conical container part 8 representing the material strand input. The transport section 29 is configured as a double pipe comprising, e.g., a longitudinally welded stainless steel pipe 32 with a stainless steel pipe bend 30 having an angle of curvature that is equal to or smaller than 75° and with an internally located sliding pipe 33 that consists of insertion pipe sections 34 that are inserted into the outer pipe 32 at the abutment sites 35 so as to slightly extend over each other. The sections 34 of the sliding pipe 33 are provided, on their inside, with a friction-reducing lining or coating, or they are configured as solid PTFE pipes having a wall thickness of 5 to 8 mm as insertable pipe parts. Fundamentally, the same also applies to the pipe bend 30. The pipe sections 34 have an inside diameter that widens from the transport nozzle array 27 toward the storage section 5, i.e., in material transport direction 111, so that the transport section 29 can be referred to as a telescope system with sectionally enlarging diameters, in which—in the regions of the respective diameter changes—the pipe sections are pushed into each other at 35 with an overlap of approximately 50 mm. In these overlap regions at 35, respectively one stainless steel centering (not specifically illustrated in FIGS. 2, 3) of the sliding pipe 33 relative to the outer pipe 32 occurs, whereas—at the abutment sites 35 themselves—gaps are provided through which the treatment fluid may exit from the sliding pipe 33, said fluid collecting in the outer pipe 32 and being drained therefrom through a drain pipe 36 into a collecting line 37 (FIG. 1). As an alternative or in addition to the gaps at the abutment sites 35, the sections 34 of the sliding pipe 33 contain, mostly in the lower pipe region, slit-shaped orifices extending into the material strand transport direction 111, a few of said orifices being indicated at 38 in FIG. 2.

In the treatment container 4, the storage section 5 is located in a cylindrical pipe piece 39 adjoining the conical container part 8 of the material strand input (as indicated at 40), said pipe piece 39 extending into the arcuate intermediate part 6 and, optionally, beyond said part, into the cylindrical head part 7. Inside the storage section 5, a sliding floor 41 is provided, which, extends at a distance from the opposing lower interior wall of the tubular housing part 39 and the arcuate intermediate part 7 and extends approximately from the connection site of the conical container part 8 to a point 42 below the horizontal loading and unloading opening 9 in the cylindrical container part 7. In the tubular container part 39, the sliding floor 41 is configured as straight inclined plane that is inclined at an angle of 15° relative to the horizontal indicated at 43 in a manner descending from the material strand input into the conical container part 8 toward the intermediate part 7. It thus forms an inclined plane that terminates in an appropriately bent sliding floor part 41*a* in the region of the intermediate part 6, said sliding floor part ultimately ending at 42 at the outside wall of the container. In the shown exemplary embodiment, the tubular container part 39 is already arranged at an angle of 15° relative to the horizontal 43; however, other embodiments are conceivable, in which case only the sliding floor 41 itself is inclined in its straight section, while the treatment container 4 is configured different therefrom. Incidentally, the tubular part 39 of the treatment container 4 may also have a shape that is different from the circular cylinder.

On its surface coming into contact with the textile product, the sliding floor 41 displays friction-reducing properties. In an embodiment as shown in FIG. 6, said sliding floor comprises parallel, adjacent PFFE pipes 44 that extend beyond the arcuate section 41*a* up to a sliding surface 45 close to the head part 7 in such a manner that the sliding floor 45 designed as an insert can be inserted from the material strand inlet side into the pipe part 39 of the treatment container 4.

Figures 6, 7:
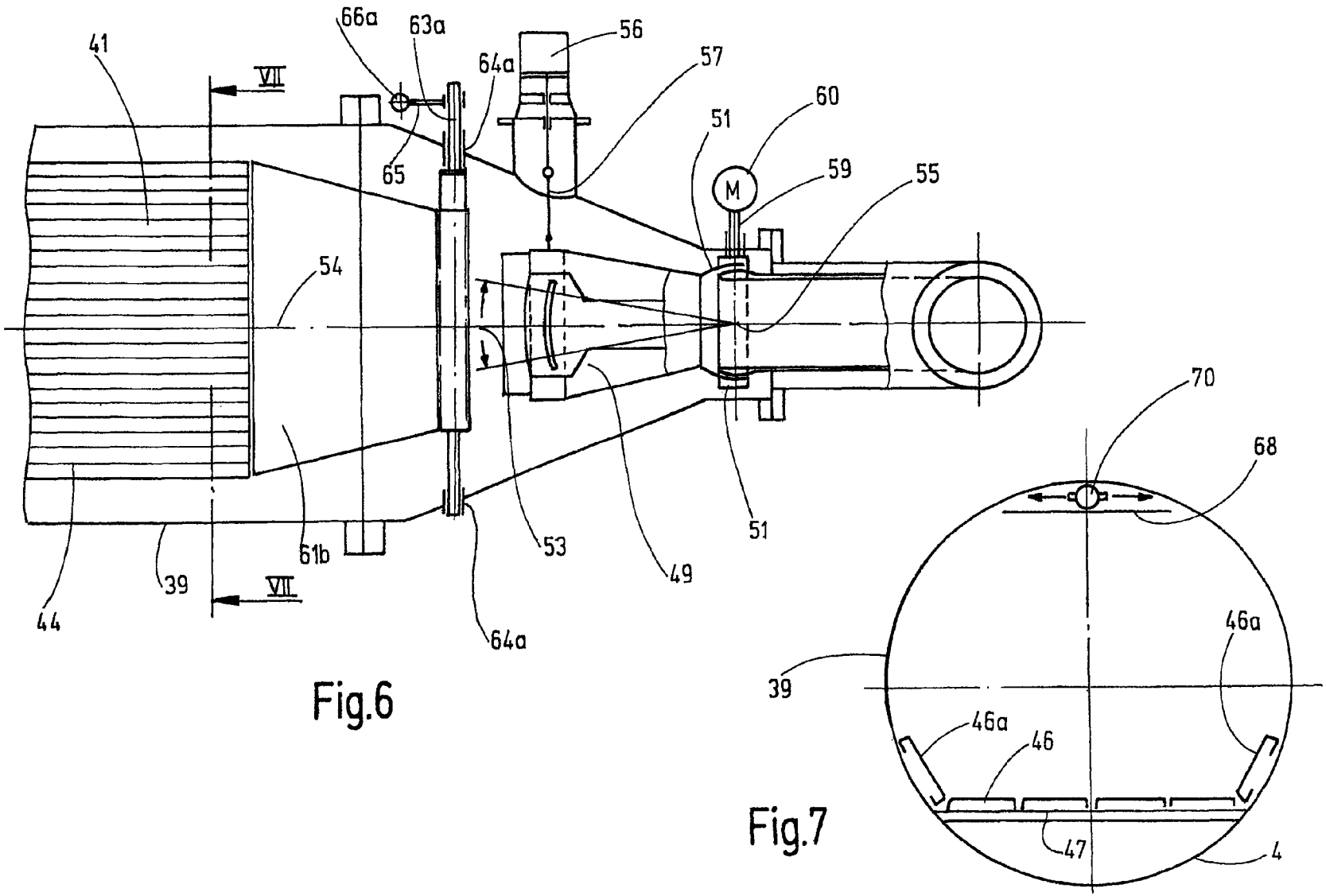
FIG. 6 a plan view of the pile-up means and the sliding floor of the arrangement in accordance with FIG. 4, in section and schematically represented.
FIG. 7 a side elevation, in section along line VII-VII of FIG. 6, of the arrangement in accordance with FIG. 6 with a modified embodiment of the sliding floor with planar construction elements.

In a modified embodiment, as is shown in particular in FIG. 7, the sliding floor 41 consists of flat PTFE construction elements 46, which, extending from a plane floor part 47 at 46*a*, are arranged laterally erect at a minimal distance next to the container wall in such a manner that the sliding floor 41 receives overall a somewhat gutter-shaped cross-sectional form. The lateral flat construction elements 46*a* are at a minimal distance from the adjacent container wall and prevent any contact of the strand-shaped material lying piled up on the sliding floor 46 with the wall of the tubular container part 39. In so doing, potential temperature differences relative to the walls are eliminated.

In the region of the arcuate section 41*a*, the preferably rectangular planar construction elements 46, 46*a* have an appropriate curvature, so that the same planar elements can be used over the entire sliding floor length, including the region of the front arcuate container part 6 and up into the head part. The lateral planar construction elements 46*a* of the embodiment in accordance with FIG. 7 can also be used in the embodiment in accordance with FIG. 6, even though, in the embodiment in accordance with FIG. 6, it is preferable to use tubular PTFE-jacketed stainless steel pipes or PFFE pipes 44 in the lateral region adjoining the flat bottom region 47 (FIG. 7).

Pile-up means 48 (a pile-up unit) are located on the material strand transport path between the transport section 29 and the storage section 5, said pile-up means being accommodated in the conical container part 8 and their details being shown in particular in FIGS. 3 through 6. The pile-up means 48 comprise an essentially funnel-shaped or nozzle-shaped pile-up element 49 that has, on the side facing the storage section 5, an elongated, oval strand exit opening 50 configured as a flat nozzle (FIG. 5) and is configured, on its opposite side, as a spherical cap 51. The spherical cap 51 can be moved in two directions at a right angle relative to each other on a spherical transport pipe holder 52 that communicates with the pipe bend 30 of the transport section 29. In particular, the pile-up element 49 can perform a pivoting movement about a pivot axis indicated at 55 perpendicular to the plane of projection in a pivot range symmetrical to the longitudinal central axis 54, as indicated in FIG. 6 at 53, said pivot movement being imposed on said pile-up means, preferably at a constant stroke, by a pressurized air cylinder 56 set on the container part 8, which is connected to the pile-up element 49 via an articulated rod linkage 57.

Figures 4, 5:
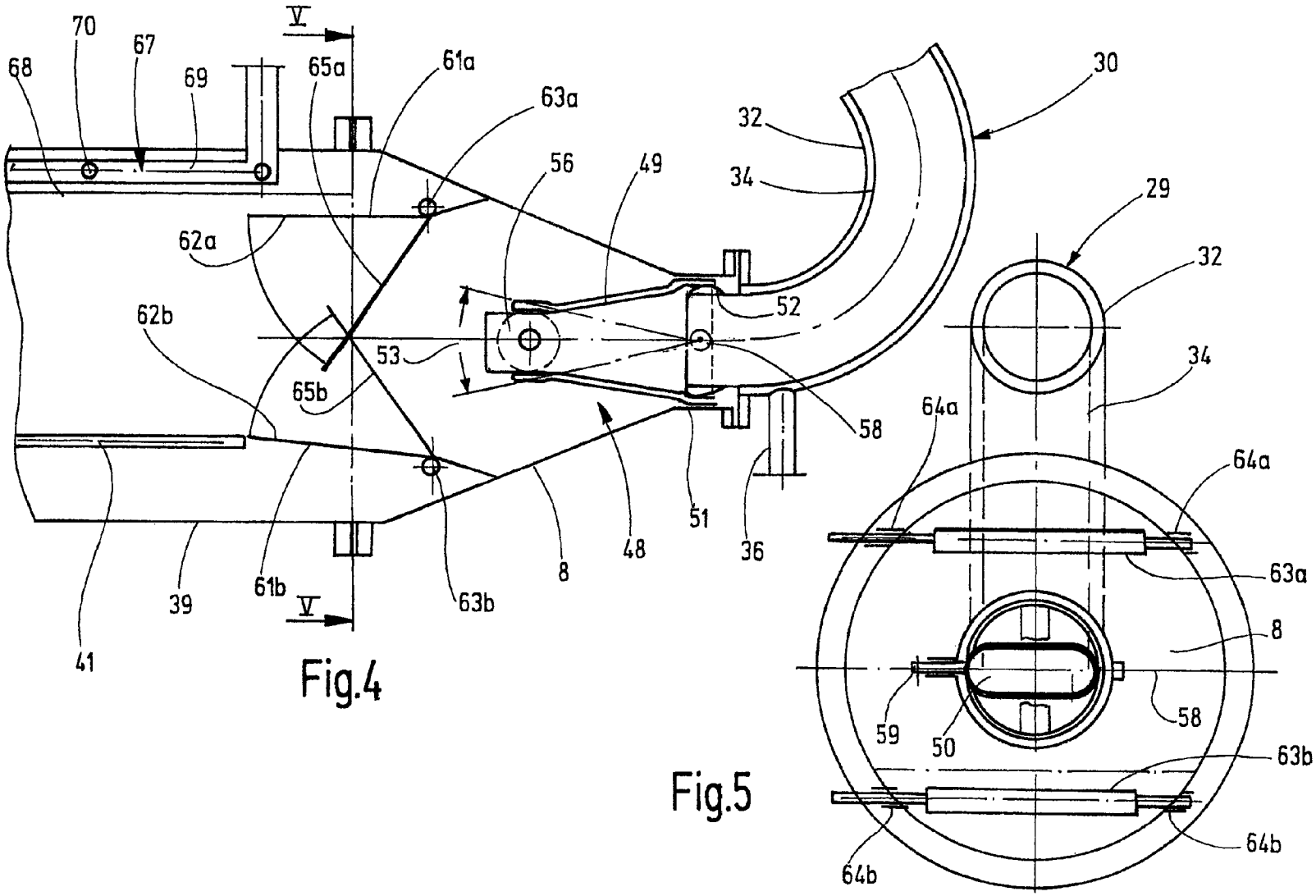
FIG. 4 a longitudinal section of the material strand inlet region of the treatment container in accordance with FIG. 1, illustrating the pile-up means, in detail, and on a different scale and schematically represented.
FIG. 5 a side elevation, in section along line V-V of FIG. 4, of the arrangement in accordance with FIG. 4.

On the other hand, the pile-up element 49 can be pivoted about a pivot axis 58 that is shown, in particular, in FIGS. 4, 5, said pivot axis extending essentially parallel to the plane containing the sliding floor 41, so that the pile-up element can perform an up-and-down pile-up movement relative to the sliding floor 41 (see FIG. 4). The stroke of the vertical pivoting movement is prespecified by the prespecified angle of a shaft journal 59, the position and arrangement of which is obvious from FIGS. 4 and 5. The actuating drive for the shaft journal 59 is a geared motor 60 (FIG. 6). Starting from the central axis 54 of the inclined tubular container part 39, the angular range corresponds to the pivoting movement in the upper and the lower material storage regions during the pile-up stroke for the material strand, i.e., the vertical deflection of the pile-up element 49 corresponds to an adjustment value that is to be prespecified in terms of a control program. In so doing, the angular velocity may be kept constant. The guide value for the full deflection, i.e., the full vertical deflection, of the material strand is a pivot time of approximately 4 seconds. The connection of the drive by the pressurized air cylinder 56 to the movement parallel to the sliding floor 41 is only required for specific goods, as will still be described with reference to the exemplary examples.

The design of the pile-up element 49 is obvious from FIGS. 4, 5, as already mentioned. The inside of pile-up element 49 is provided with a friction-reducing lining, or the pile-up element may also be made as an isostatically pressed PTFE formed element that comprises—for the transfer and for the receipt of the forces to be initiated for the pile-up movement—an external jacket, e.g., in the form of an externally applied flat steel.

Between the material strand exit from the nozzle orifice 50 of the pile-up element 49 and the storage section 5 of the treatment container 4, two pivotable planar baffle elements are provided, these being configured as baffles or baffle plates 61*a*, 61*b* and being pivotable in particular in the manner as can be seen in FIGS. 4 through 6. On their insides 62*a* and 62*b*, respectively, they are provided with a friction-reducing coating. The two baffles 61*a*, 61*b* are pivotally supported at a vertical distance from the strand outlet opening 50 of the pile-up element 49 near the upper or the lower wall of the conical container part 8 by means of an actuating shaft 63*a* and 63*b*, respectively, at 64*a* and 64*b*, respectively (FIG. 5), whereby the pivoting range is indicated in dashed lines in FIG. 4 at 65*a* and 65, respectively. The actuating shafts 63*a*, 63*b* are respectively coupled, via a lever arm 65, with an actuating pressurized air cylinder, one of which being indicated at 66*a* in FIG. 6.

In the non-pivoted starting position shown in FIG. 4, in which the upper baffle 62*a* extends approximately parallel to the sliding floor 41 and the lower baffle 61*b* forms a slightly ascending insertion sliding surface for the incoming material strand relative to the sliding floor 41, the two baffles 61*a*, 61*b* essentially do not influence the material strand exiting from the pile-up element 49.

In the pivoted-in state as indicated by the pivoting ranges 65*a*, 65*b*, the baffles 61*a*, 61*b* have a compressive effect on the material strand exiting from the material strand opening 50 of the pile-up element 49, this effect being used to influence the surface and to decompact the material structure as will be explained in detail hereinafter with reference to an example.

The pivoting movement sequence of the two baffles 61*a*, 61*b* may be coupled with the movement of the pile-up element 49 in such a manner that respectively the baffle 61*a* or 61*b* positioned in the pivoting direction of the pile-up element 49 pivots toward the starting position in accordance with FIG. 4, whereas the opposing baffle does not pivot out, so that the movement of the two baffles 61*a*, 61*b* is alternately coupled with the pivoting movement of the pile-up element 49 occurring in vertical direction, said pile-up element being controlled by the geared motor, thus aiding the piling-up process.

A spray device 67 is arranged above the sliding floor 41 in the vicinity of the upper container wall in the storage section 5 of the straight pipe part 39 of the treatment container 4 contained in the sliding floor 41, said spray device being shielded against the sliding floor 41 by a cover 68 extending over the length of the storage section. The spray device 67 comprises a number of spaced apart flat jet nozzles 70 on parallel nozzle axes and extending from a common supply line 69 (FIG. 4), said flat jet nozzles being able to rinse the inside of the container wall of the container part 39 with a rinsing fluid. The fluid—as a rule, rinsing water—spread by the flat jet nozzles 70 performs several tasks. On the one hand, said fluid cleans the rinsed container wall. On the other hand, it—e.g., after hot discharge of the hot treatment fluid (bath) from the treatment container—achieves the cooling of the entire machine system and of the batch of strand material circulating in demoisturized state to a product temperature of approximately 85° C. This cooling represents an essential procedure, because it is expedient, in particular in the case of high-temperature (HT) bleaching in high-temperature dying processes or in the case of steam treatments, to uniformly cool the machine system consistent with a cooling gradient to the respectively subsequent treatment step, which, in many applications, means a cooling to a range of 85° C.

The rinsing or cooling fluid flowing downward on the container wall does not come into contact with the strand-shaped textile product lying on the sliding floor 41 in the storage section 5. The fluid film runs laterally past the sliding floor 41, in which case, to accomplish this, said floor's laterally erect elements 46*a* (FIG. 7) extend at a minimal distance from the adjacent container wall.

Regarding its embodiment, the transport nozzle array 27 essentially corresponds to the type of design explained in the Applicant's German patent application 10 2007 019 217.9. Therefore, regarding details, reference may be made to this earlier patent application. However, it should be noted that also other embodiments of Venturi transport nozzles may be used, should this appear practical for the respective purpose of use of the apparatus. One advantage of the transport nozzle array 27 (with FIG. 8 only showing its essential details) comprising adjustment regions for the adjustment of the inflow cross-section of the transport gas stream and comprising a separation of the treatment gas fluid injection of the gas stream into two sections consists—among other things—in that material strand finishing can be achieved at high material velocities of up to 1000 meters per minute with a perfect treatment of the textile product.

Figure 8:
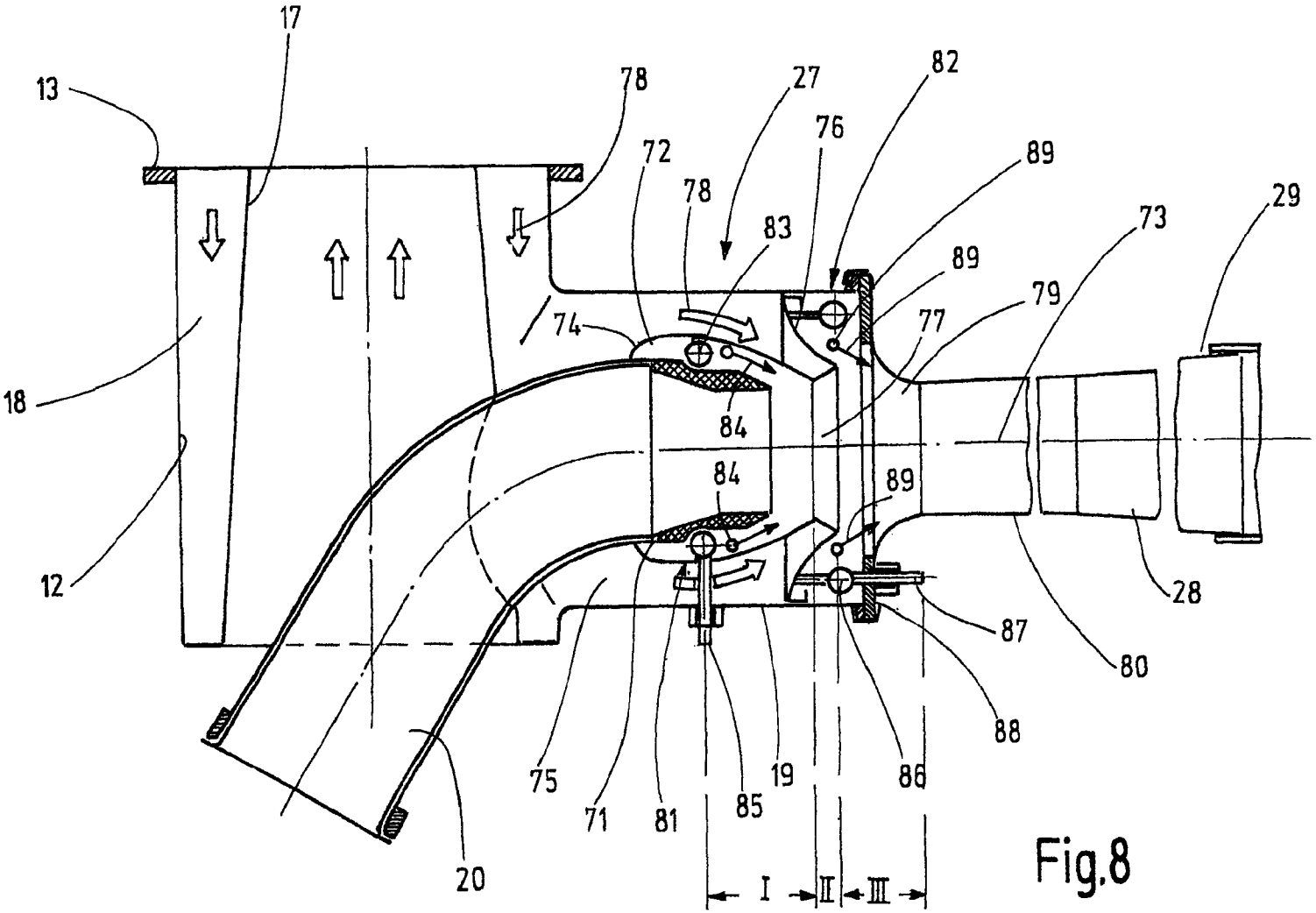
FIG. 8 a side elevation, schematically represented on a different scale, of the transport nozzle array of the apparatus in accordance with FIG. 2.

From FIG. 8 it is obvious that the material strand inlet part 20 leads to an inlet nozzle part 71 of the Venturi transport nozzle of the transport nozzle array 27, in which case this can also be referred to as the jet apparatus. An inflow nozzle formed element 72 having essentially the form of a truncated cone is connected in a sealed manner to the tubular material strand inlet part 20, said nozzle formed part being coaxial to the outflow-side transport nozzle axis 73 and enclosing the inflow nozzle part 27 at a radial distance. The inflow nozzle formed part 72 is flow-facilitating on its outside and is welded on the outside at 74 to a rounded, integral closure part so as to be sealed to the material strand inlet part 20. The inflow nozzle formed part 72 and the inlet nozzle part 71 are enclosed by the cylindrical nozzle housing 12 that is coaxial to the transport nozzle axis 73, whereby the inside wall of said housing extends at a radial distance from the nozzle formed part 72. In the manner obvious from FIG. 8, the material strand inlet part 20 and the inflow nozzle molded part 72, together with the transport nozzle housing 19, delimit a transport medium inflow channel 75 that communicates with the pressure channel 18 of the blower unit 14.

Arranged inside the cylindrical transport nozzle housing 19 is an outer nozzle formed element 76 that is sealed on the edge side and has essentially the shape of a funnel or a trumpet, said nozzle formed part, together with the inflow nozzle formed part 72, delimiting a guide channel that is coaxial to the transport nozzle axis 73 and has an annular gap 77.

The annular gap 77 is charged with a transport gas stream—indicated by arrows 78 in FIG. 8—by the blower unit 14. The radial width of the guide channel and the annular gap 77 can be varied by axial shifting of the outer nozzle formed element 76 in the transport nozzle housing 19 and thus be adjusted to the respectively most favorable operating conditions.

Adjoining the annular gap 77 and at an axial distance from the transport nozzle axis 78, is an essentially funnel-shaped inlet part 79 for a subsequent, essentially cylindrical mixing section 80 for the treatment and bath streams and for the transport gas stream that terminates in the downstream diffuser 28. As already explained and obvious from FIG. 2, the transport section 29 adjoins the diffuser 28.

Two discrete injection jet nozzle systems 81, 82 are provided in the transport nozzle housing 19, said system being arranged at an axial distance from each other along the transport nozzle axis 73 and coaxially thereto. The first injection jet nozzle system 81 comprises a cylindrical treatment agent or bath distributor ring 83 that is attached from the outside to the inlet nozzle part 71 and bears a number of flat jet nozzles indicated at 84 (charge elements). The treatment agent or bath is supplied through an outward-directed connecting pipe 85. The jet nozzles 84 spray the treatment agent (bath), fed to them via the connecting pipe 85, in vaporized form at a prespecified jet angle onto the material strand exiting from the inlet nozzle part 71, before the material strand exits from the inflow nozzle formed part 73 and is charged with the transport gas stream from the annular gap 77.

The described first injection jet nozzle system 81 is located in a first section I of the transport nozzle array 27, said section I extending approximately from the bath distributor ring 7 up to the mouth of the inflow nozzle formed part 72, viewed in transport direction of the material strand.

As is obvious from FIG. 8, adjoining the section I is a second section II or an intermediate region in the transport nozzle array 27 in transport direction 111 of the material strand. In this second section II, the passing material strand is charged with the transport gas stream exiting from the annular gap 79.

Thereafter, the material strand enters a third section III of the transport nozzle array 27, said section approximately extending between the outer nozzle formed part 76, i.e., the boundary of the annular gap 77 formed by said array, up to the end of the mixed section inlet part 79, viewed in transport direction of the material strand. Arranged in this third section is the second injection jet nozzle system 82 that has a treatment agent or bath distributor ring 86 coaxial to the transport nozzle axis 73, whereby, in the shown exemplary embodiment, said distributor ring has a greater diameter than the bath distributor ring 83 of the first jet nozzle system 81. The second bath distributor ring 86 communicates with an axially aligned connecting pipe 87 for the supply of bath, said connecting pipe being sealed by an annular plate 88 that can be closed by a nozzle housing 19 and being directed toward the outside. The bath distributor ring 86 bears—distributed over its circumference—a number of injection jet nozzles 89 (charge elements) that are aligned in such a manner that the fluid jets exiting from the jet nozzles 89 transmit a force component to the passing material strand in the transport direction of the material strand. These jet nozzles 89 of the second injection nozzle system 82 also apply the treatment agent (bath) in vaporized form to the material strand, i.e., in such a manner that the material strand is enclosed by the application region in a ring-shaped manner.

Viewed in material strand moving direction, a deflecting roller 90 located in the cylindrical container part 7 (FIGS. 1, 2) is arranged upstream of the material strand inlet part 20, said roller being selectively driven by a variable drive 91 depending on the strand-shaped textile product to be respectively treated in order to aid the material strand transport, or said roller may be used as an idling roller. In the case of applications with connected roller drive, the rate of revolutions of the roller, i.e., its circumferential velocity, is controlled corresponding to the strand moving velocity.

Above the deflecting roller 90 and also in the cylindrical container part 7, a guide roller 92 is provided, said roller enlarging the wrap angle of the deflecting roller 90 when the deflecting roller 90 is pivoted away and thus leading, for the most part, to a separation of the fluid introduced in the interstices of the textile product due to a spraying of the material strand with a liquid treatment agent (e.g., rinsing water) that can be selectively actuated along the material strand moving path upstream of the deflecting roller. Pivoting of the guide roller 92 is achieved by a pressurized air cylinder indicated at 93 (FIG. 1), while spraying of the material strand from a nozzle indicated at 94 (FIG. 1) may take place. An oval guide ring 95, through which the material strand passes, is disposed to center the material strand upstream of the deflecting roller 90.

Below the treatment container 4 supported by supports 96 on the ground, two treatment agent and bath receiving containers 97, 98 are provided, said containers communicating with the interior space of the treatment container and being disposed to receive the treatment agent (bath) draining from the textile material strand. The treatment agent receiving container 97 is dimensioned in such a manner that the total treatment fluid quantity contained in the treatment container 4, minus the treatment agent portion carried by the material strand, can be accommodated.

The bath receiving container 98 that communicates with the treatment agent receiving container 97 via a shut-off fitting 99 (FIG. 1) is disposed to receive treatment agent (bath) as a receiver for a bath pump 100, and to act as a receptacle and to equalize the concentration in so-called replenishing baths when the treatment agent receiving container 97 is shut off. In so doing, a treatment agent circulation may take place—via the bath pump 100 and a heat exchanger 101 and via connecting lines 102, 103, whereby the connecting line 103 contains a shut-off valve 104—through the treatment agent receiving container 98, with the treatment agent injection into the transport nozzle array 27 being blocked, during a prespecified mixing period and at the treatment agent temperature intended for this circulation. Each of the two treatment agent receiving containers 97, 98 is configured as a pipe in the manner obvious from FIG. 1, whereby the treatment agent containers 4 of all three parallel-connected treatment apparatus 1, 2, 3 of the piece-dyeing machine or plant in accordance with FIG. 1 communicate with the treatment agent receiving container 97.

The operation of the HT piece dyeing machine described so far is as follows:

After introducing a material strand as shown in FIG. 1 at 111 into the treatment container 4 through the temporarily opened loading opening 9, the ends of the material strand 110 are connected to each other so that a continuous strand is formed, whereby, in the manner obvious from FIG. 1, said strand enters—via the transport roller 90—the transport nozzle array 27, is driven therein in a material strand transport direction indicated by arrow 111, uniformly soaked with a treatment agent, and is transported—via the diffuser 28—into the transport section 29. Leaving the transport section 29, the material strand 110 arrives on the sliding floor 41 of the storage section 5 due to the pile-up element 49 of the pile-up means 48 configured as a flat nozzle, in which storage section said material strand is pleated into a material strand package as is fully schematically indicated at 112 in FIG. 1. Then the material strand 100 is again lifted out of the storage section 5 by means of the deflecting roller 90 and guided into the inlet part 20 of the transport nozzle array 27 that is charged with the transport gas stream by the blower unit 14.

As the material strand passes through the transport section 29, the material strand expands due to the increasing inside diameter of the sliding pipe in transport direction, with the result that, due to the turbulent flow conditions of the flowing gas stream prevailing in the sliding pipe and due to the relaxation achieved because of the enlarging diameter, a high degree of separation of the treatment fluid carried along by the material strand 110 is achieved, thus preventing residual amounts of treatment agent in the fiber and yarn interstices from spreading unevenly in the depositing material strand package 112 at the time of the material strand's entrance into the treatment container 4 in the region of the material storage section 5. Such an uneven distribution would require additional material strand cycles with the appropriate adaptation regarding temperature range, etc., in order to achieve a uniform distribution of, e.g., borderline treatment states, e.g., in the application region of a dye, in order to achieve uniform color shading. As is obvious from FIG. 1, the separating treatment fluid, which exits through the treatment agent passages 38 from the sliding pipe 33 and collects in the outer pipe 32 of the transport section 29, is conveyed through the collecting line 37 into the treatment agent receiving container 97.

Corresponding collecting lines 37 are also provided in the apparatus 1, 2 that are only schematically indicated in FIG. 1.

Another advantage of the above-explained inventive embodiment of the transport section 29 as a double-pipe construction is the possibility of adjusting the amount of treatment agent injected in the transport nozzle array 27 at a higher level than corresponds to the absorption and loading capacity of the passing material strand 110, because, also in this case, the draining of excess amounts of treatment agent is ensured through the slot-like passages 38 and the collecting line 37, so that, upon introduction of the treatment strand 110 in the treatment strand storage, no additional treatment agent is brought in.

The advantage of an injection with excess treatment agent in view of the absorption and loading capacity of the passing material strand is an accelerated distribution of a new treatment agent preparation, so that a reduction in time can be achieved in view of the uniform bath distribution during such a treatment step. This also applies to rinsing operations for rinsing out foreign substances, in which case a reduction of the rinsing time necessary to accomplish a prespecified residual concentration is achieved. A further advantage of the embodiment of the transport section 29 in the form of a double pipe is to be viewed in that the material strand does not come into contact with the outside surface of the transport section, i.e., with the outer pipe 32, but is isolated therefrom. Incidentally, this condition also applies during continued passage of the piled-up material strand through the treatment container 4, because the PTFE lining 46*a* (FIG. 7) on both sides of the sliding floor 41 prevents such contact.

The material strand exiting from the flat-nozzle-type exit opening 50 of the pile-up element 49 of the pile-up means 42 is piled up, so that a material strand package is formed on the sliding floor 41 in the material storage section 5. The height of this material strand package is defined by the stroke of the pile-up element 49 in the stroke range of the geared motor 60 in vertical direction. The width of the material strand package can be affected by pivoting the pile-up element 49 in the horizontal plane by means of the pressure cylinder. In each case, this is achieved in that the piled-up material strand package is distributed essentially over the entire length of the sliding floor, so that, as a result of this, an excessive compaction of the piled up material strand is prevented, in which case, due to an adjustable high material strand velocity, an opening and transfer of the material strand is achieved. On entry of the material strand in the material storage, as already mentioned, there is no excess treatment agent that would lead to an uneven distribution on the material and could impair the opening and transfer of the material strand.

Figure 9:
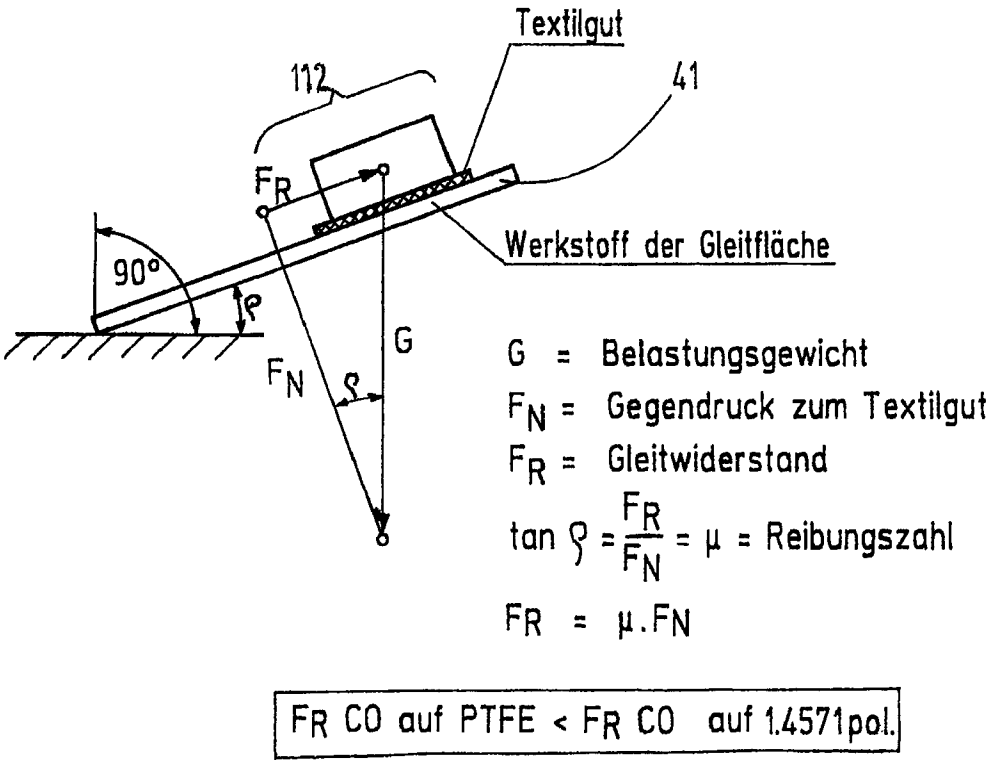
FIG. 9 a diagram to illustrate the forces acting on the material strand package in the material storage of the apparatus in accordance with FIG. 2; and, FIG. 10 the arrangement in accordance with FIG. 1 illustrating a modified embodiment.

The material strand package formed on the sliding floor 41 slides, following gravitational force, downward on the straight portion of the sliding floor 41 that represents an inclined plane. The friction ratios applicable here are schematically illustrated in FIG. 9: In accordance with Coulomb's law of friction, the friction between the material strand package and the sliding floor 41 is a function of the pairing of opposing materials, i.e., of the fiber material of the textile product, the PTFE of the sliding floor 42, of the lubricating conditions (and thus, among other things, the viscosity of the treatment bath carried by the textile fiber assembly of the material strand), and of the planar compaction of the material strand package. The force diagram shown in FIG. 9 relates to the angle that is subtended by the straight portion of the sliding floor 41 and the horizontal in the treatment container 4, so that the same conditions result for the sliding movement of the piled-up strand-shaped product over the length of the straight portion of the sliding floor 41. In FIG. 9, the material strand stack is schematically indicated at 120.

The excellent sliding properties of PTFE achieve, as already mentioned, that no excessive compaction of the material strand package occurs and, as a result of his, the material strand package may spread uniformly on the sliding floor 41. The force diagram shows the following: the angle of inclination $\sigma$ of the sliding surface 41, which, in the present case, is preferably 15° relative to the horizontal; the textile product supported by the sliding floor 41, said product being represented by the loading weight G of the material strand package; the resultant counter-pressure FN with respect to the material strand stack seated on the sliding surface; and the slippage resistance FR. The coefficient of friction $\mu$ corresponds to the tangent $\rho$=FR/FN, where FR=$\mu\times$FN. Referring to the mentioned angle $\rho$=15°, the tangent $\rho$ corresponds approximately to the coefficient of friction $\mu$ typically occurring with the use of a textile material strand.

Because of the large inside surface of the tubular part 39 of the treatment container 4 and because of the permanent contact with the amount of gas flowing in from the transport section 29 when the spray device 67 is actuated, the gas stream taken in by the blower unit 14 and, therefore, also the materials strand 110 moving into the transport nozzle array 27 are cooled, which is of advantage during specific treatment steps.

The treatment agent (bath) that has been schematically illustrated only in its essential parts in FIG. 1 has already been described in part. Beyond this, FIG. 1 shows that—on the suction side of the bath pump—the line 102 contains a shut-off fitting 113 that, when shut off, permits the supply of a treatment agent preparation or replenishment from a preparation or replenishment container 114. For metered treatment agent replenishments, a metering pump 115 is connected parallel to this connection, said pump also permitting the treatment agent replenishment with excess pressure prevailing in the machine system and at higher treatment temperatures.

On the suction side of the bath pump 100—also for the supply to the treatment fluid preparation or replenishment container 114—supply lines 116 such as, for example, connections for various types of water, are provided; whereas on the side of the treatment agent receiving container 98, connections for the treatment agent (bath) discharge are provided, whereby one treatment agent drain 117 is used for treatment agent at 85° C. and one treatment agent drain 118 is used as high-temperature bath drain.

On the suction side of the bath pump 100, the line 102 to the bath receiving container 98 contains a coarse filter 119 for filtering out coarse impurities such as residual fibers, etc. On the pressure side of the bath pump 100, the pressure line 103 also contains a self-cleaning filter system 120 that continuously allows fuzz to be filtered out of the treatment agent, e.g., when knit products with short-pile yarns are used and, in particular, also when products of cellulose—namely Lyocell®—are used, in which case this is useful due to the discharge of fibers during defibrillation. The filter substrate can be discharged from the filter system 120 through a drain fitting 121.

Downstream of the heat exchanger 101, appropriate shut-off and control valve 122, 123, 124 containing lines 124, 125, 127 branch off the pressure line 103 of the bath pump 100, said lines leading to the treatment agent connecting pipes 85, 87 of the transport nozzle array 27 (FIG. 8) and to the spray nozzle 94 upstream of the deflecting roller 90. In addition, a line 129 is branched off here, said line containing a shut-off valve 130 and being connected to the supply pipe 69 of the spray device 67 (FIG. 4).

The respective lines and valves for the two apparatus 1, 2 are only schematically indicated.

Naturally, it could also be possible to supply the transport nozzle array 27, etc., of the individual apparatus 1, 2, 3 independently of each other.

The required pressure equalization required for proper flow distribution in the parallel-connected treatment containers 4 is achieved by a pressure equalization line 1300 that is connected to the pressure equalization line 23 of each of the apparatus 1, 2, 3, respectively, by means of connecting pipes 26. This pressure equalization line 1300 is also provided with connections 131 for pressurized air and 132 for nitrogen gas, e.g., for vat-dyeing cotton. A ventilation fitting is connected to a second pressure equalization line 133 arranged parallel to the pressure equalization line 1300, said equalization line 133 also serving all the apparatus 1, 2, 3 in the same manner and being connected to their respective equalization lines 23.

The HT piece-dying machine or plant shown in FIG. 1 differs from those in accordance with FIG. 1 only in that it represents an expansion of the plant in accordance with FIG. 1. Therefore, only the additional elements are depicted.

Figure 10:
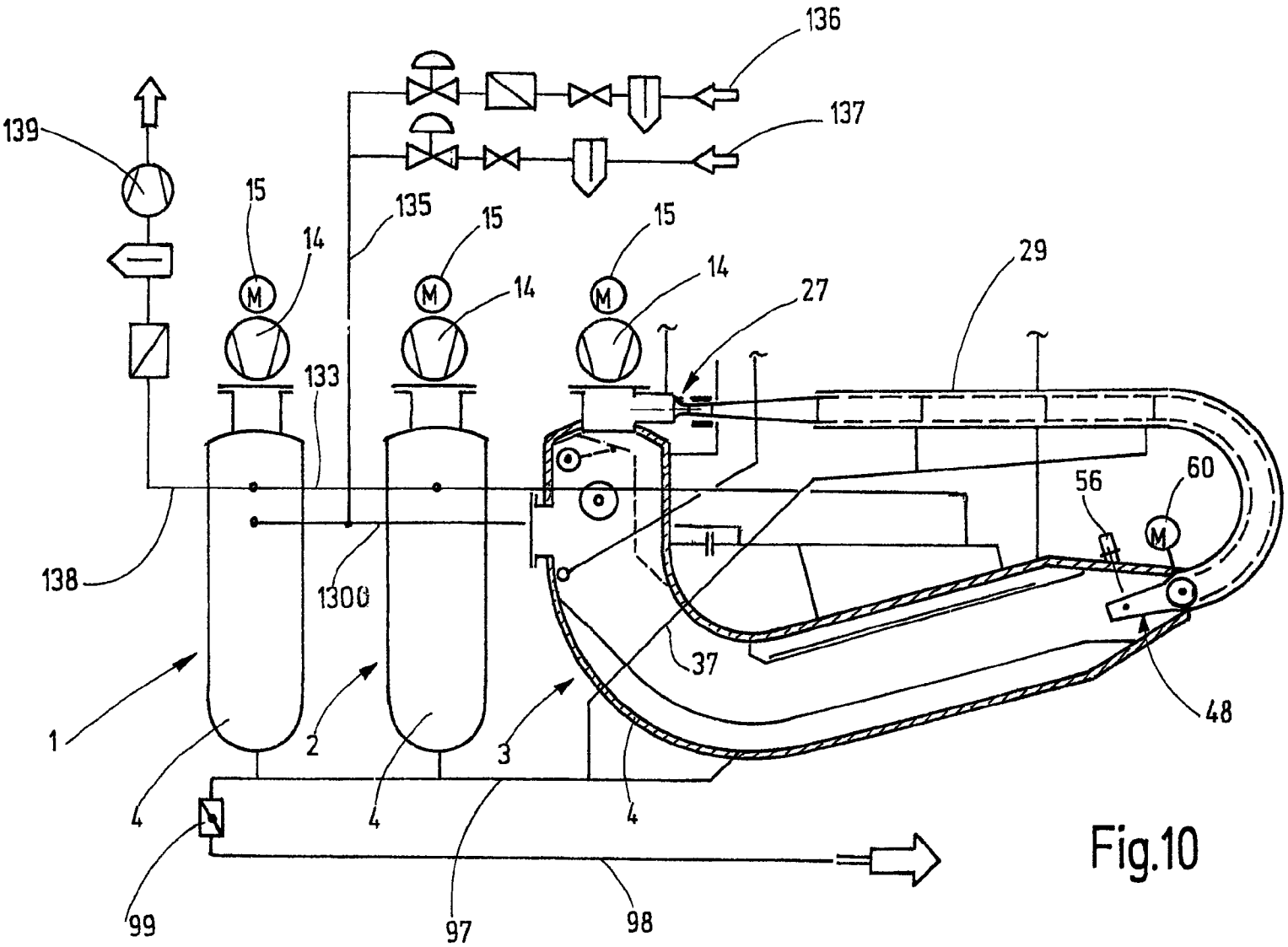

The machine or plant in accordance with FIG. 10 is disposed, in particular, to make possible a steam treatment of strand-shaped textile products and therefore comprises a direct connecting line 135 connected to the equalization line 1300, whereby said line 135 can be selectively used, at 136, for the supply of water vapor in saturated state and, at 137, for the supply of water vapor in overheated state via appropriate, not specifically identified, shut-off fittings and control fittings with water with a water separator, etc. The advantage of such a steam treatment are explained in conjunction with an exemplary embodiment.

In conjunction with the direct steam inflow, extending from the equalization line 133, a line 138 for the gas outflow—and, separate therefrom, a line for the outflow of a steam/air mixture—is provided, said line 138 containing a water separator and a vacuum pump 139.

Exemplary Embodiment 1

Polyester knit goods in the form of loom-state tubular material having a weight of 110 g/m$^2$, corresponding to a batch weight of 220 kg of a material web length of 1070 m, are treated.

The HT goods-dyeing machine comprising 3 parallel-connected treatment containers 4 that was used corresponds to the schematic shown in FIG. 1, with the add-on device 135, 136, 137 for the direct steam supply in 2 steam qualities as saturated water vapor and as overheated water vapor, and with an outlet 138 for the exiting steam/air mixture, with the condenser, separator and vacuum pump 139.

Intended is a 0.76% dispersion dyeing with two commercially available dispersion dyes, i.e., Resolin® Blue, K-FBL 300 0.60% and Terasil® Blue, BGF 400 0.16%.

In preparation for loading the machine, a total batch in three connected batch pieces having an approximate length of 1000 m each, is provided. A temperature of 60° C. is set for the wash bath intended for the pre-wash cycle in the preparation/replenishment container 114.

In order to load the treatment container 4, the strand start of each of the three material stacks is fastened to the closure 10 of the three treatment containers and, in direct succession—when actuating the blower units 14 at the mean rate of revolutions and the actuation of the batch pump 100, when actuating the fittings required for filling the treatment bath, and when actuating the connection fittings to the transport nozzle array 27, and when actuating the material strand pile-up device 49 for the full pivot angle—the material pieces are successively moved in.

Upon entry, the blower unit 14 belonging to the respective treatment container 4 is switched off, the material start is pulled through the guide ring 95 located below deflecting roller 90, and the strand ends are sewn together.

Subsequently, the treatment bath prepared with chemicals and auxiliary agents, whereby said bath containing the equalizing auxiliary agent and the sodium acetate, as well as the acetic acid for adjusting the pH value, as well as the two dispersion dyes, is heated to 60° C. and, upon discharging the intermediate rinsing bath through the injection nozzles 84, 89 with the blower unit 14 switched on again, is distributed over the moving material stand 110, while the pile-up is actuated at the same time. Now a material velocity of 700 m/min is adjusted.

After the inflow of the treatment batch and after switching to circulation, heating to 90° C. takes place at 6° C. per minute, with the addition of the direct super-heated steam at 137. A holding time of 3 minutes corresponding to the material circulation occurs at 90° C. Heating to 110° C. with a gradient of 2° C./minute follows. Then heating to 133° C. at 6° C./minute follows and then a holding time of 20 minutes at 133° C.

Upon dyeing, the hot discharge using the fitting 118 occurs with an opening time of 3 minutes for steaming out the batch. The inside wall rinsing device 67 is actuated for cooling to 86° C. the steam condition existing in the machine system due to the hot discharge. The batch insert of the strand-shaped product continues to remain at the material velocity of 700 m/min, whereby, at 80° C., however only 10% of the reducing agent amount usually used in dyeing is added for reductive post-cleaning.

After 10 minutes of treatment, warm-rinsing and the usual lowering of the rinsing temperature to 40° C. are accomplished through the injection nozzles 84, 89.

The total treatment time for this dispersion dyeing procedure, including the pre-wash cycle for cleaning and stabilizing the loom-state goods, is 180 minutes, including the time for loading and unloading. With the use of this treatment, the required washfastness of the material is achieved.

Exemplary Embodiment 2

A fabric of an outer wear material is treated.

It is a woven product in linen weave consisting 100% of Lyocell® cellulose fiber yarns.

Intended is a 3.5% reactive dyeing in accordance with the 60° C. constant temperature process, the usual removal by washing out unfixed reactive dyes with the simultaneous neutralization of the residual chemicals in the dye bath.

The residual fibers accumulating during defibrillation of the Lyocell® fiber yarns and, in particular during the enzymatic treatment, are filtered out of the bath stream by the self-cleaning filter system 120 and collected, below the filter tube, in a space from which they are drained from the filter—after said space has filled accordingly—in that the drain fitting 121 is opened, without interrupting the bath circulation.

The filter substrate volume, considering this product, is in a range of 8%, with respect to the batch used.

Considering the present batch length of 950 m, a material velocity in the range of 600 m/min is adjusted by way of the blower unit 14, and the injection batch amount flowing into the transport nozzle array 27 is adjusted in such a manner that it is above the loading capacity of this material. As a result of this, the fabric surface is subject to a corresponding loss because individual fibers are washed away, thus ensuring that the excess amount of the injected bath in the transport section 29 is returned to the bath receiving container 97. This means that a collection of bath at the time of input in the storage container 15 does not exist, so that the opening and transfer of the material strand via the pile-up means 49 is ensured.

After dyeing, the usual post-cleaning of the reactive dyeing with the appropriate rinsing processes, is now followed—as the new treatment option—by a tumbler treatment as the dry treatment, in order to obtain the desired voluminous hand and softness of the goods.

The injection cycle is deactivated during tumbler treatment and the material strand velocity is adjusted upward to 900 m/min The desired treatment temperature is achieved by adding the direct overheated vapor gas, in which case the tumbling process is coupled with the movement of the pile-up means 49 by alternately pivoting in the baffles 41*a*, 41*b*. Due to this tumbler treatment, a two-step method has been provided, whereby a demoisturizing of the product occurs depending on the number of steps.

The number of steps of the separate heat supply—without evaporation and without the downstream vacuum step with evaporation—depends on the performance values desired of the method, whereby the heat supply with super-heated steam offers a heat release without condensation of the steam, and whereby the evacuation is performed at most up to a moisture temperature of the material of 60° C., corresponding to an absolute value of approximately 200 mbar. In so doing, a condensation occurs based on a temperature that is lower than the saturation temperature.

The fuzz discharge in the gas stream occurring in the course of the tumbler treatment is collected by a removable filter panel 22 located in the head part 7 of the treatment container 4.

What is claimed:

1. An apparatus for treatment of strand-shaped textile products in the form of a continuous material strand, which is circulated at least during part of the treatment, comprising:

an elongated, substantially tubular treatment container that has a material strand inlet and a head part containing a material strand outlet, a transport nozzle array that can be charged with a gaseous transport medium stream, a transport section that adjoins the transport nozzle array, opens into a storage section of the treatment container at the material strand inlet, and is provided on its inside with a surface having low friction in relation to the material strand, wherein the storage section is arranged in the treatment container adjoining the material strand inlet, and receives a piled-up material strand package, and wherein said storage section has: (i) a sliding floor for the material strand package located at a distance above a container wall below, and (ii) a pile-up unit for the material strand between the sliding floor and the transport section, wherein the pile-up unit comprises a funnel-shaped pile-up element which extends longitudinally inside the treatment container and which has an opening through which the material strand passes, and wherein the sliding floor is inclined in a manner descending in a straight line from the pile-up unit toward the head part so as to form an inclined plane, a pipe bend which is provided between the transport section and the pile-up unit of the treatment container, wherein the pipe bend has an exit path that is parallel to a longitudinal direction of the sliding floor, and a blower unit that is allocated to the head part of the treatment container and that is connected to the transport nozzle array, wherein charge elements are provided at least in a region of the transport nozzle array in order to charge the material strand with a liquid treatment agent.

2. The apparatus in accordance with claim 1, wherein the transport section comprises devices for draining excess treatment agent carried along by the material strand.

3. The apparatus in accordance with claim 2, wherein the transport section comprises a double-walled pipe with an internally located sliding pipe displaying minimal friction with respect to a surface of the material strand, wherein the internally located sliding pipe has passages for the liquid treatment agent which is collected in an outer pipe of the transport section and which can be discharged through drains in said outer pipe.

4. The apparatus in accordance with claim 3, wherein the internally located sliding pipe is assembled, at least partially, of coaxial pipe sections.

5. The apparatus in accordance with claim 4, wherein, viewed in a material strand transport direction, the sliding pipe sections have a respectively larger or enlarging diameter.

6. The apparatus in accordance with claim 4, wherein the passages for the treatment agent are provided at connecting sites of abutting sliding pipe sections.

7. The apparatus in accordance with claim 3, wherein the internally located sliding pipe has elongated slots on an underside thereof configured as the passages for the liquid treatment agent.

8. The apparatus in accordance with claim 3, wherein the outer pipe has a number of treatment agent drain pipes at a distance from each other in a material strand transport direction, and wherein said drain pipes are connected to a treatment agent collecting line.

9. The apparatus in accordance with claim 8, wherein the collecting line terminates in a treatment agent receiving container which can be put in connection with the treatment container.

10. The apparatus in accordance with claim 9, wherein the treatment agent receiving container is configured as a double pipe, including a first pipe which is connected to the treatment container, and a second pipe which is connected to the first pipe by way of a shut-off fitting.

11. The apparatus in accordance with claim 9, wherein the treatment agent receiving container is located in a circulation line containing a pump, wherein said circulation line can be used to transport the treatment agent contained in the treatment agent receiving container in a circulation system that is separate from the treatment container.

12. The apparatus in accordance with claim 1, wherein the sliding floor is inclined by approximately 10° to approximately 30° relative to a horizontal direction.

13. The apparatus in accordance with claim 1, wherein the sliding floor has tubular elements arranged in parallel next to each other, said tubular elements displaying low friction with respect to a surface of the material strand.

14. The apparatus in accordance with claim 13, further comprising a sliding surface which is provided upstream of the tubular elements in a material strand moving direction, and which guides the material strand coming from the material strand inlet to the sliding floor.

15. The apparatus in accordance with claim 13, wherein, in a region of transition to the head part of the treatment container, the sliding floor is configured in the form of a front pipe bend where the tubular elements are curved.

16. The apparatus in accordance with claim 1, wherein the sliding floor has flat construction elements which have friction-reducing properties with respect to a surface of the material strand and which have a substantially gutter-shaped cross-sectional form, wherein at least elements that laterally extend upward from a floor part are arranged with a gap from an adjacent container wall.

17. The apparatus in accordance with claim 16, wherein the flat construction elements are substantially rectangular.

18. The apparatus in accordance with claim 16, wherein the flat construction elements are provided over a length of the sliding floor, including a region of a front pipe bend of the sliding floor and up into the head part.

19. The apparatus in accordance with claim 1, wherein said pile-up element is supported so that it can be moved in at least two directions of movement that are different from each other, and wherein said pile-up element is coupled with drive elements which impart it with controlled movement in the at least two directions.

20. The apparatus in accordance with claim 19, wherein the pile-up element is supported at a first end by a ball joint.

21. apparatus in accordance with claim 20, wherein the pile-up element is configured as a spherical cap at the first end and is supported on a corresponding stationary ball joint element so as to be movable in all directions.

22. The apparatus in accordance with claim 19, wherein the pile-up element can be moved in a direction that is substantially parallel to a floor part of the sliding floor, and in a transverse direction that is substantially at a right angle thereto.

23. The apparatus in accordance with claims 19, wherein the opening of the pile-up element is a nozzle part configured as a flat nozzle, and wherein a longer transverse axis of the nozzle part is aligned substantially parallel to a floor of the sliding floor.

24. The apparatus in accordance with claim 1, further comprising pivotally supported planar baffle elements which are arranged in a material strand moving direction between a material strand exit of the pile-up unit and the storage section, wherein said baffle elements are controllable as a function of movement of the pile-up unit that effects piling-up of the passing material strand.

25. The apparatus in accordance with claim 24, wherein the baffle elements comprise baffles or baffle plates which are pivotally arranged above and below the material strand exit of the pile-up unit and are disposed to act as material strand guides.

26. The apparatus in accordance with claim 25, wherein the baffle elements are disposed so as to be movable independently of each other.

27. The apparatus in accordance with claim 1, wherein at least in a region of the storage section, the treatment container contains a device which applies a coolant stream to an inside wall of the treatment container.

28. The apparatus in accordance with claim 27, wherein the treatment agent is used as the coolant.

29. The apparatus in accordance with claim 27, wherein the device has spray nozzles arranged above the sliding floor in the treatment container, and wherein said spray nozzles are shielded with respect to the material strand package lying on the sliding floor and apply the coolant stream to the inside wall of the treatment container.

30. The apparatus in accordance with claim 1, wherein the head part of the treatment container is connected to a tubular container part comprising the storage section in order to form a J-shaped container, and wherein the blower unit is attached to a vertically upward extending portion of the head part, said blower unit communicating with an inside of the treatment container on a suction side and communicating with the transport nozzle array on a pressure side.

31. The apparatus in accordance with claim 30, wherein the blower unit comprises an intake pipe coaxial to the head part of the treatment container and comprises a pressure channel also coaxial to the head part.

32. The apparatus in accordance with claim 1, wherein the transport nozzle array comprises at least one Venturi transport nozzle having a nozzle axis and having an annular nozzle gap that can be charged with the transport medium, and wherein in a first section upstream of the annular gap in a transport direction of the material strand and in a second section downstream of the annular gap in the transport direction, the treatment agent can be applied to the material strand such that the material strand is at least partially enclosed in a ring-shaped manner.

33. The apparatus in accordance with claim 32, wherein, in an intermediate section between the first and second sections, the material strand can be charged with the gaseous transport medium.

34. The apparatus in accordance with claim 1, wherein said apparatus is connectable to another similarly constructed apparatus to form a treatment plant for the treatment of several material strands, each material strand having its own treatment container and its own transport section with the transport nozzle array, and wherein the treatment plant comprises a treatment agent receiving container shared by all of the treatment containers together, and wherein all collecting lines for the treatment agent extending from the transport sections terminate in said treatment agent receiving container.

* * * * *